United States Patent [19]

Wilhoite

[11] 4,424,934

[45] Jan. 10, 1984

[54] HOT WATER HEATING SYSTEM

[76] Inventor: Murray O. Wilhoite, 121 Creekwood Cir., Florence, Ala. 35630

[21] Appl. No.: 251,859

[22] Filed: Apr. 6, 1981

[51] Int. Cl.[3] ..... F24H 3/06

[52] U.S. Cl. ..... 237/7; 236/10; 237/16; 126/101

[58] Field of Search ..... 237/16, 51, 19, 7; 126/101, 5; 122/20 B; 236/10

[56] References Cited

U.S. PATENT DOCUMENTS 2,952,409 9/1960 Matthews ..... 236/70

4,124,178 11/1978 Burke ..... 237/19

4,210,102 7/1980 Dosmann ..... 122/20 B 4,342,422 8/1982 Davis ..... 237/19

*Primary Examiner*—Albert J. Makay

*Assistant Examiner*—Henry Bennett

*Attorney, Agent, or Firm*—C. A. Phillips

[57] ABSTRACT

A hot water heating system wherein an air-to-water heat exchanger is attached to the outside of a jacketed space heater, and a fan draws hot air through an opening in the jacket and downward through the heat exchanger.

5 Claims, 4 Drawing Figures

HOT WATER HEATING SYSTEM

TECHNICAL FIELD

This invention relates generally to water heating, and particularly to devices and systems for heating water from a combustion type space heater or furnace.

BACKGROUND ART

At one time, one of the principal devices for heating domestic hot water was a water jacket built into a wood or coal burning kitchen stove. Typically, a water storage tank would be positioned beside the stove, and water would be heated by thermal cycling from the water jacket to a tank. Such combinations were not completely safe as pressure buildup due to steam could result in an explosion. They have now been largely replaced by separate stove and water heating units, each being powered by its own heat source, typically gas or electricity. Currently manufactured hot water heaters typically consist of a tank which is fed from a cold water line and a thermostatically controlled heat source which generally maintains water temperature at a selected level in the range of approximately 120° F. to 190° F. In order to prevent an explosion in the event that a heating unit does not properly turn off, these hot water heaters are equipped with a combination pressure-temperature (PT) relief valve which opens a drain when one of the parameters exceeds a selected level, typically 150 PSI in pressure or 210° F. Since the thermostatic controls of the heaters are quite reliable, typically having a life expectancy of approximately 10 years, the pressure-temperature sensitive relief valves are designed for only emergency operation and not repetitive operation. This is significant, as will be explained.

Fairly recently, and in the wake of a tremendous upsurge in the usage of wood burning space heaters, a number of water heaters have appeared for these space heaters. Typically, they include some form of heat exchanger which either directly receives heat from a combustion chamber of the space heater, or from air heated by the combustion chamber. Most frequently, the output of these hot water heaters is used as a supplementary heat source for heating water in a tank of a standard gas or electrically powered hot water heater of the type described above. Unfortunately, insofar as is know, none of the water heaters for space heaters provides means of prevention of their raising the temperature above the pop-off temperature of the PT valve of the basic hot water heater with which they are to be used. Of course, when water overheating does occur, the PT valve will open and hot water will be drained each time that it occurs. Not only does this provide a waste of water, but some, perhaps many, PT valve drains are not connected to the outside of a dwelling, and there may result in drainage on the floor of a dwelling. More importantly perhaps, and as described above, PT valves are simply not constructed for repetitive action, and thus they mail fail in such usage, and this may lead to an explosion.

Accordingly, it is an object of this invention to provide a space heater type hot water heater which overcomes the problems discussed and which is safe, convenient, and efficienct.

DISCLOSURE OF THE INVENTION

In accordance with this invention, an enclosed air-water heat exchanger is attached to the outside of the jacket of a jacketed combustion type space heater. Openings are formed in an upper region of the enclosure of the heat exchanger common to openings in the jacket of the space heater, and a fan pulls air through these openings and down through the heat exchanger and exhausts it to the surrounding air. Thus, no heat flows through the heat exchanger except when the fan is on. The fan is controlled by a water sensing thermostat which turns the fan off when water temperature rises above a selected level, e.g., 180° F.

Equally important is the fact that the system is a failsafe system in that if the power goes off, the fan stops operating and heat to the heat exchanger is cut off. Then, by virtue of gravity, cool room air will flow through the heat exchanger. This prevents uncontrolled water heating.

Typically, to enhance or replace thermal cycling between the heat exchanger and a conventional gas or electrically heated tank, a circulating pump is employed, and it and the fan would be operated "on" responsive to a jacket air temperature above a selected temperature, e.g., 120° F. This insures that the system is not operated unless there is some significant heated air available.

DETAILED DESCRIPTION OF THE DRAWINGS

Figure 1:
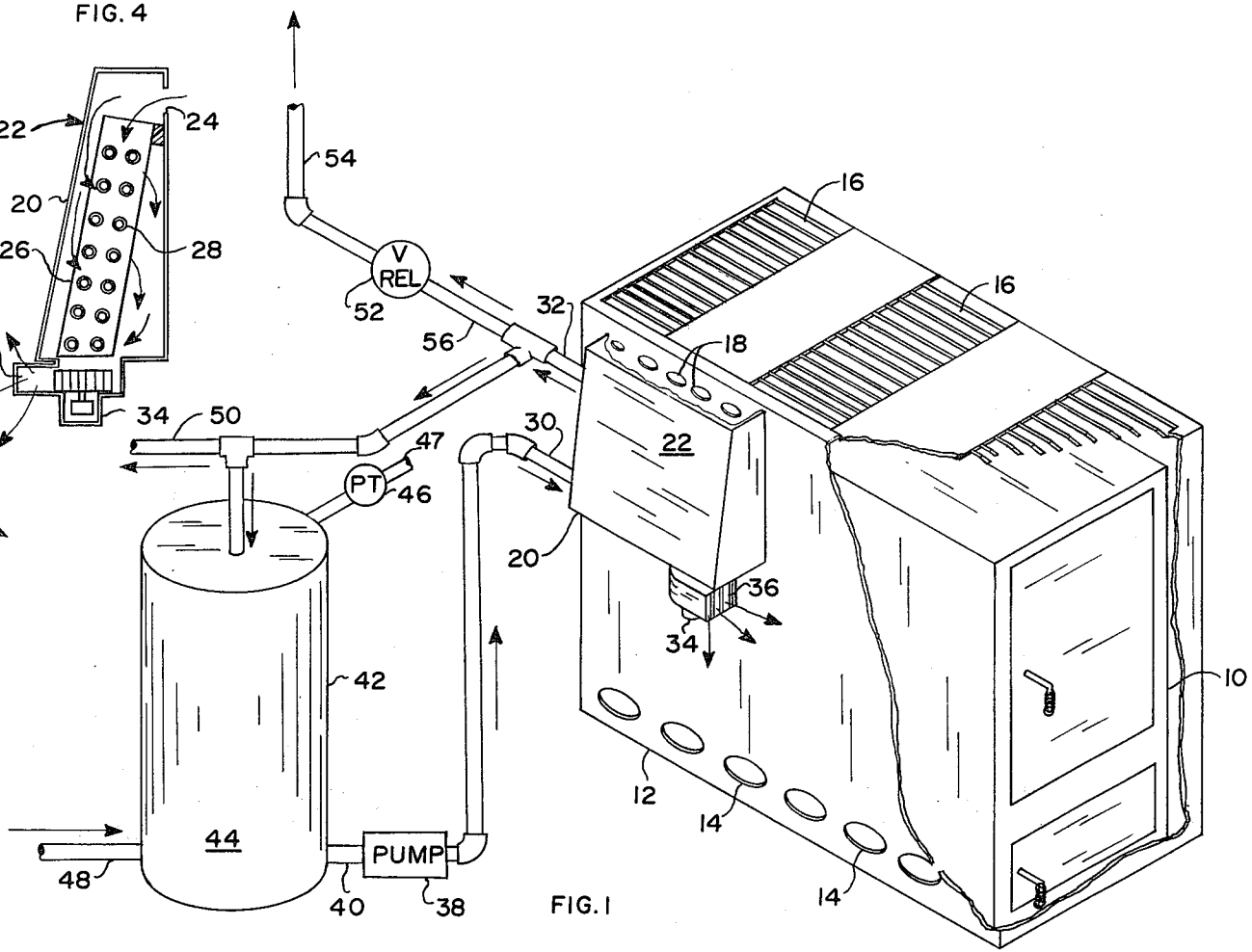
FIG. 1 is a perspective view illustrative of the system of this invention.
Figure 4:
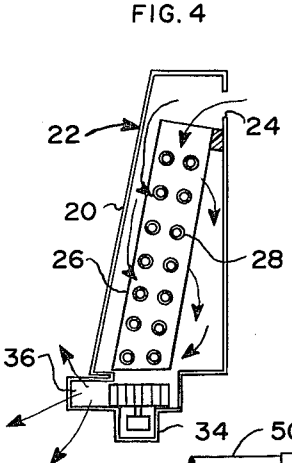
FIG. 4 is a sectional view taken along line 4—4 of FIG. 3.
Figure 3:
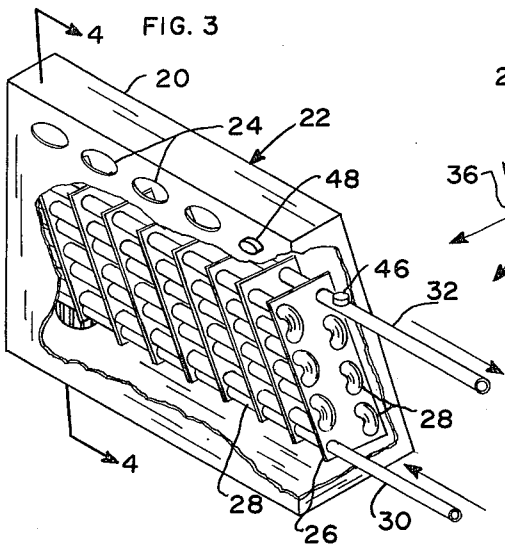
FIG. 3 is a perspective view of a heat exchange assembly employed in this system.

Referring to FIG. 1, a conventional combustion type space heater 10, e.g., a wood burning heater, is equipped with a surrounding jacket 12 having air entrance openings 14 and air exit opening 16 through which room air circulates and is heated. Additionally, a series of openings 18 are provided in one side of jacket 12, and these provide an air passageway to enclosure 20 of hot water heater 22 through an opening or openings 24 of enclosure 20 (FIGS. 3 and 4). Enclosure 20 is attached to jacket 12 by conventional means (not shown).

Hot water heater 22 (FIGS. 3 and 4) employs a heat exchanger 26 formed of tubing 28 held in a spaced configuration as shown by tubing 28. A water inlet pipe 30 connects to the tubing of the heat exchanger at a low point as shown, and an outlet pipe 32 connects to an upper point on the tubing (also shown). A fan 34 is mounted at the bottom of enclosure 20 opposite exhaust opening 36. When operating, it draws air inward from jacket 12 through openings 14, 16 and 18, then through heat exchanger 26 (as shown by the arrows) and out opening 36.

Figure 2:
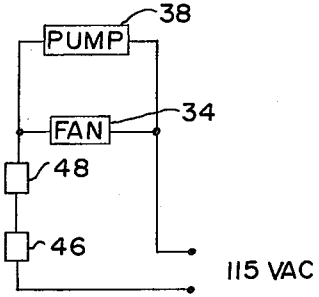
FIG. 2 is an electrical schematic diagram of the electrical circuitry employed in this system.

Water to be heated is drawn by pump 38 through pipe 40 from tank 42 to a conventional gas or electrically heated water heater 44. Control of pump 38 and fan 34 is effected by means of water temperature responsive switch 46 and jacket air temperature responsive switch 48. Air temperature sensing switch 48 extends into the space within jacket 12 and is a normally open switch which closes when the air temperature sensed exceeds a selected temperature, for example, 120° F. It insures that the system is not operated unless heater 10 is providing some significant heat output. Water temperature responsive switch 46 senses water temperature in water outlet pipe 32 and is a normally closed switch which opens when it senses a water temperature which exceeds a selected value, for example, 180° F. It provides a safety function in that it prevents an overheating condition which would trip PT valve 46 in drain pipe 47 extending from water heater 44. As shown in FIG. 2, switches 46 and 48 are connected in series to supply power to both fan 34 and pump 38, thus both must be operated closed to effect operation of either fan 34 or pump 38.

Water to be heated initially is supplied to gas or electrically heated water heater 44 through a conventional cold water line 48, and water is supplied from water heater 44 through hot water pipe 50. Typically, the thermostat of water heater 44 (not shown) would be set to heat water to a temperature of 130° F. and turn off. Thus, when water supplied by heat exchanger 26 is sufficient to hold the temperature of water in hot water heater 44 above this level, the thermostat of hot water heater 44 would not effect a turn "on" of power or gas to effect heating, saving energy. As air temperature sensing switch 48 is adapted to turn on only when the air temperature in jacket 12 reaches, for example, a temperature of 120° F., water is only pumped through the heat exchanger when significant heat will be delivered by the heat exchanger to the water. As water temperature switch 46 is set to open at a selected upper temperature above that which would be regarded as a too hot temperature (e.g., 180° F.), this leaves a margin of safety insofar as a possible dangerous temperature or pressure building in the system is concerned.

As a further safety feature of this invention, however, a pressure and temperature relief valve 52 would be connected in a line 54, in turn connected to exit line 56 from heat exchanger 26. Typically, it would be set to open and thus provide a pressure and temperature relief for the system at a pressure in excess of 150 PSI, or a temperature of 210° F.

To examine operation of the system, it will be assumed that initially there is no fire in the combustion chamber of space heater 10. In that posture, air temperature responsive switch 48 would remain open. Thus, neither pump 38 nor fan 34 would be operated, and hot water heater 44 would operate in its normal mode to maintain a water temperature level as set by its thermostat.

With a fire in the combustion chamber of heater 10, and a rise in temperature in jacket 12 such that air temperature responsive switch 48 closes, fan 34 and pump 38 would be turned on. As a result, air from jacket 12 will be drawn down through enclosure 20, and the now heated air would give up heat to heat exchange tubes 28 to thus heat water. Pump 38 would circulate the heated water into tank 42 of hot water heater 44, causing the water temperature to rise, its magnitude of rise depending upon water usage and temperature of space heater 10. If the water temperature reached a temperature of 180° F., water temperature sensing switch 46 would open and thereby cut off fan 34 and pump 38. With fan 34 turned off, no further heat would be applied to heat exchanger 26 until there had occurred water usage to draw the temperature down below the temperature of operation of switch 46, at which point it would turn back to a closed position, and fan 34 and pump 38 would again operate. In the event of a power failure, both fan 34 and pump 38 would be turned off, and no water heater effect would occur. Further, when the water in tank 42 is heated to 180° F., the pump and fan will cut off. Thus, this is a failsafe system as, no matter how hot space heater 10 becomes, water will not be significantly further heated.

I claim:

1. A hot water heating system comprising:

a combustion type heater having a combustion chamber, a jacket around said chamber, and an air inlet in said jacket for the introduction of air to be heated;

an enclosure attachable to a side of said jacket, an entrance opening in said jacket to an upper region of said enclosure, and an exit opening at a lower region of said enclosure;

an air-water heat exchanger within said enclosure and positioned to intercept air flow between upper and lower regions of said enclosure;

an electrically powered fan positioned to draw air through said entrance opening in said jacket, through said heat exchanger, and out said exit opening;

temperature sensing switching means for sensing the temperature in said enclosure and operating "on" said fan at a temperature above a selected level; and second temperature sensing means for sensing the temperature of water flowing through said heat exchanger and operating "off" said fan at a temperature above a selected value.

2. A system as set forth in claim 1 including a tank and means in circuit with said tank and heat exchanger for circulating water through said tank and heat exchanger.

3. A system as set forth in claim 2 including second temperature sensing means for sensing the temperature of water flowing through said heat exchanger and operating "off" said fan at a temperature above a selected value.

4. A system as set forth in claim 2 wherein said means for circulating water is a pump, and said temperature sensing means includes means for operating "on" said pump at a said temperature above a said selected value.

5. A system as set forth in claim 4 including second temperature sensing means for sensing the temperature of water flowing through said heat exchanger and operating "off" both said fan and said pump at a temperature above a selected value.

* * * * *